US007311645B1

(12) United States Patent
Lynch

(10) Patent No.: US 7,311,645 B1
(45) Date of Patent: Dec. 25, 2007

(54) ABDOMINAL EXERCISE MACHINE

(75) Inventor: Louis Lynch, Oakland Park, FL (US)

(73) Assignee: AB-Stractor LLC, Boca Raton, FL (US)

( * ) Notice: Subject to any disclaimer, the term of this patent is extended or adjusted under 35 U.S.C. 154(b) by 0 days.

(21) Appl. No.: 11/540,329

(22) Filed: Sep. 29, 2006

(51) Int. Cl.
*A63B 26/00* (2006.01)

(52) U.S. Cl. ..... 482/142; 482/121

(58) Field of Classification Search ..... 482/121–131, 482/142; D21/676, 686, 690
See application file for complete search history.

(56) References Cited

U.S. PATENT DOCUMENTS 4,517,966 A 5/1985 von Othegraven
D329,672 S 9/1992 Shieh
5,387,171 A 2/1995 Casey et al.
5,423,731 A * 6/1995 Chen ..... 482/130
6,248,047 B1 6/2001 Abdo
6,309,329 B2 10/2001 Conner
6,602,171 B1 8/2003 Tsen et al.
2004/0043877 A1 3/2004 Brown
2005/0101460 A1 5/2005 Lobban
2006/0160683 A1* 7/2006 Schenk ..... 482/907

* cited by examiner

*Primary Examiner*—Lori Amerson
(74) *Attorney, Agent, or Firm*—Laurence A. Greenberg; Werner H. Stemer; Ralph E. Locher

(57) ABSTRACT

An exercise machine has a main frame for placement on a support surface and a seat supported on the main frame. The seat is movable between a horizontal position and a vertical position. A post having an integrated resilient member is supported by the main frame, the integrated resilient member is disposed at least one foot above the seat. A handle bar is attached to and extends from the post. A downward movement of the handle bar is resisted by the integrated resilient member.

19 Claims, 5 Drawing Sheets

ABDOMINAL EXERCISE MACHINE

BACKGROUND OF THE INVENTION

1. Field of the Invention

The invention relates, generally, to exercise machines, and more specifically, it relates to exercise machines that target the abdominal muscle group.

2. Description of the Related Art

Such exercise machines generally exercise at least one of the muscles of the upper and lower abdomen, the internal and external obliques, the rectus abdominus, the muscles of the spinal column including the erector spinal, the intercostals, the steratus anterior, the latissmus dorsi, the trapezium, the fascia infraspinata, the teres minor and the teres major, without putting undue strain on the lumbar and the cervical spinal discs.

Swaying, pivoting, rocking, bending forward, backward, and sideways, circular twisting, lateral bending, forward flexion, rearward extensions, and rotating motions of the upper body are basic movements of the human body. Movements of such nature against resistance has an effect upon the expansion and contraction of the affected muscles of the abdomen, of the spinal column and of the lower back to strengthen and tone all of the major muscles of the upper and lower abdomen, the obliques and major muscles of the spinal column.

Conventional approaches to training and strengthening of the muscles of the human body generally utilize a method of providing resistance to body movements of the user. A problem can result in that the resistance offered to movement of the human body and of specific muscles can lack control measures to prevent any unbalanced stress or strain that may induce injury by an uncontrolled movement.

U.S. Pat. No. 6,602,171 to Tsen et al. teaches an abdominal exercise machine which focuses on reducing fat around the abdomen so as to improve the health of the user. The Tsen taught machine has a frame for sitting on the ground and a seat disposed on the frame. A set of selectable springs allows one to set the spring tension or resistance of the machine. The springs are located on the lower half of the machine, between the seat and the floor. An overhead handle bar works in conjunction with a waist level pivot point. The user sits in the seat and bends at the hips for performing the exercise. A further embodiment allows an angled movement rather than a straightforward bend at the hip. However, the springs are positioned so low on the frame that the user must bend at the hip and does not fully utilize all the abdomen muscles. More specifically, the position of the springs only allows one to move generally forward or with a slight angled motion to the side. The pivot at the lower back or waist position, limits the use to a bending of the hip motion (e.g. bending forward). In addition, no armrests are provided for exercising the lower abdomen muscles.

U.S. Pat. No. 6,248,047 to Abdo teaches another abdominal exercise machine having a base stand upon which a seat is supported. A tension spring is positioned between the seat and the handle bars at a lower back position that causes the user to bend at the hips and allows a full range of hip flexor movement. This however results in limited abdomen utilization and specifically does not allow one to isolate the obliques. Furthermore, there is no armrest and therefore no lower abdomen exercises are possible with the Abdo taught device.

The above-noted inventions each provide a simple exercise device which permits the exercising and strengthening of the mid-section of the body and protects and serves to reduce undue stress and strain upon the lower back and the lumbar region by limiting ones movement and limiting the number or types of exercises that can be performed. There is a need for an exercise machine that reduces undue stress but also exercises all of the above-described muscle groups.

SUMMARY OF THE INVENTION

It is accordingly an object of the invention to provide an abdominal exercise machine, which overcomes the hereinmentioned disadvantages of the heretofore-known devices of this general type, and provides a greater range of muscle training.

With the foregoing and other objects in view there is provided, in accordance with the invention, an exercise machine. The exercise machine has a main frame for placement on a support surface and a seat supported on the main frame. The seat can be moved or pivoted between a horizontal position and a vertical position. A post is formed with an integrated resilient member and is supported by the main frame. The integrated resilient member is disposed at least one foot above the seat. Preferably, the integrated resilient member is disposed at least 18 inches above the seat for eliminating hip flexor interaction. A handle bar is attached to and extends from the post. A downward movement of the handle bar is resisted by the integrated resilient member.

The abdominal exercise machine targets the abdominal muscle group while keeping the user in a safe upright position leaving less room for injury to the back and neck area. The tension bands provide various levels of difficulty allowing inexperience as well as advance fitness enthusiast to use the device with ease and effectiveness. The abdominal exercise machine provides a large variation of movements to equally work all areas of the abdominals including the obliques with almost no change in position. In addition the abdominal exercise machine can fold down for easy storage and disassembly for shipment.

In accordance with an added feature of the invention, the handle bar has a sinuous shape and has main arm members extending from the post at an angle of between 40-70 degrees. Preferably, the end of the handle bar has a reverse S shape. The handle bar is rotatably mounted to the post and rotates between a horizontal and vertical position.

In accordance with a further feature of the invention, a further post adjustably and releasably receives and supports the post, the further post is supported by the main frame. A seat back is connected to the further post. The integrated resilient member is disposed above the seat back. An armrest having a clamp is pivotably connected to the further post for moving the armrest between a vertical and horizontal position. Preferably, the armrest has a pair of padded arms and two hand grips.

In accordance with an additional feature of the invention, the post has a plurality of holes and the further post has an opening for receiving the post and a pin for engaging the holes in the post for releasably and adjustable holding the post. Ideally, the pin is a quick fit pull pin.

In accordance with a further additional feature of the invention, at least one tension band is supported by the post for increasing a resistance of the integrated resilient member. The post has two rods extending from a rear of the post for engaging the at least one tension band.

In accordance with another further feature of the invention, a bracket is adjustably connected to the main frame, and a base post is pivotably mounted to the bracket and receives the further post in an adjustable and releasable manner. The further post has a plurality of further holes and the base post has a locking pin for engaging one of the further holes for holding the further post in a releasable and adjustable manner. The main frame has a plurality of frame holes and the bracket has a frame locking pin for engaging in the frame holes for adjustably and releasably fixing the bracket to the main frame.

In accordance with another added feature of the invention, the integrated resilient member is a spring allowing a user to bend forward and side-to-side while gripping the handle bar. Preferably, the integrated resilient member is positioned at a level of a shoulder of a user resulting in a concentrated abdominal muscle affect with little hip flexor interaction.

In accordance with a concomitant feature of the invention, a set of rollers is attached on a first end of the main frame and a handle is attached to a second end of the main frame, the second end being opposite to the first end. Preferably, the main frame is and an I-shaped main frame. The I-shaped main frame has a vertical member with one horizontal member disposed at each end of the vertical member. Ideally, the vertical member is formed with two releasably interconnecting components.

Other characteristic features of the invention are set forth in the appended claims.

Although the invention is illustrated and described herein as embodied in an abdominal exercise machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
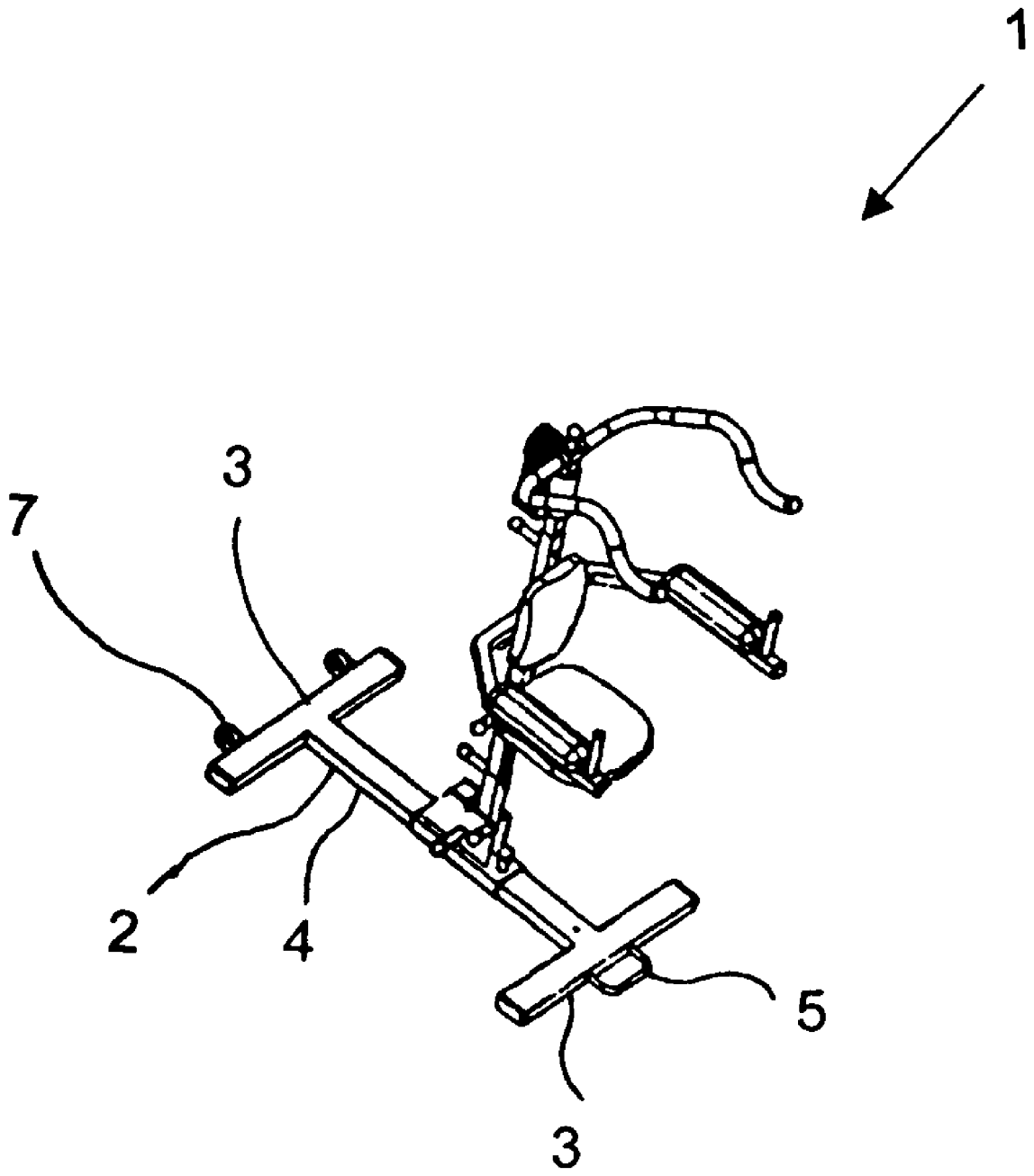
FIG. 1 is a diagrammatic, top perspective view of an abdominal exercise machine according to the invention.
Figure 5:
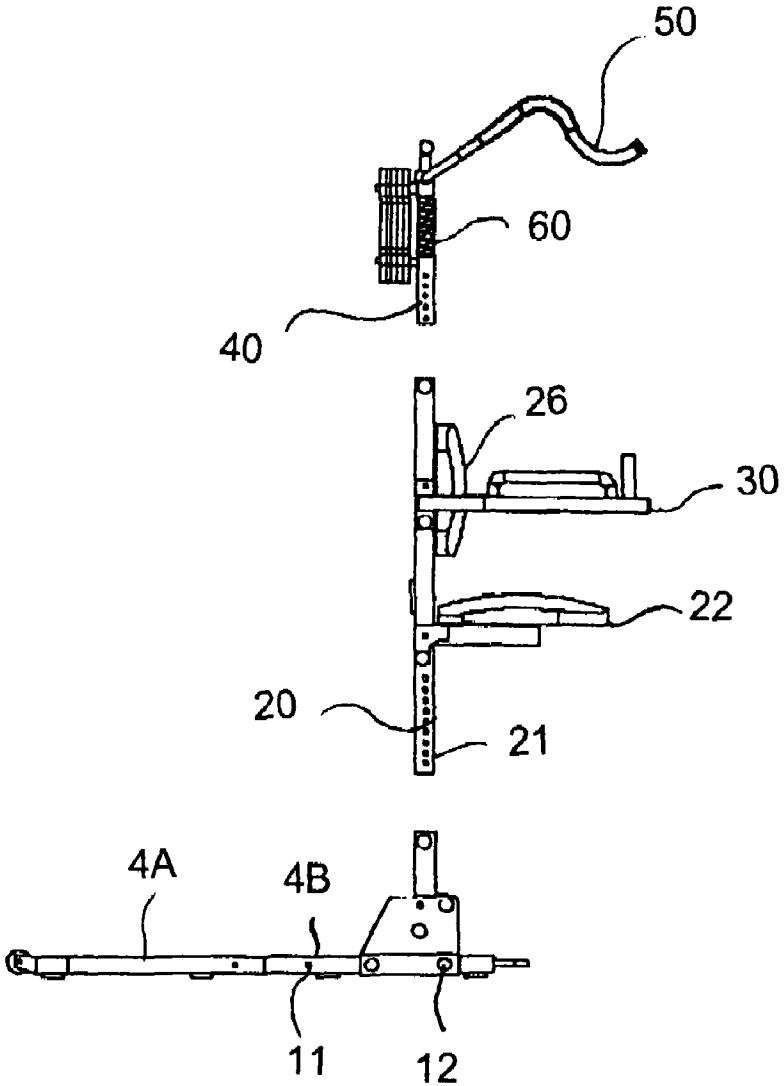
FIG. 5 is a diagrammatic exploded, side view of a second embodiment of the exercise machine with a seat and armrests in a horizontal position.

Referring now to the figures of the drawings in detail and first, particularly, to FIG. 1 thereof, there is shown a top perspective view of an abdominal exercise machine 1 formed of a base frame 2 in a shape of an I-frame. Obviously any shape will suffice but an I-frame supplies greater horizontal and vertical stability and at the same time is easy to manufacture. The I-frame 2 is formed of a vertical member 4 and two horizontal members 3. The members 3, 4 are all of a general rectangular shape with flat, top, bottom and side surfaces and preferably made of metal. The members 3, 4 can be formed as a single unit with members 3 attached (e.g. welded) to each end of member 4. Optionally, the vertical member 4 can be formed of two interlocking pieces including a first vertical member 4A sliding into a second vertical member 4B as best shown in FIG. 5. In this manner the frame 2 can be disassembled for a more compacting shipping and storing configuration.

At the front of the frame 2 is a handle 5 being of any shape but in FIG. 1 is shown as a U-shaped handle 5 attached in the middle of the front horizontal member 3. The middle position being chosen as it provides a perfect balance of the exercise machine 1 during transport. On the rear horizontal member 3 is disposed a pair of rollers, wheels or casters 7 for assisting in transporting the exercise machine 1. Clearly by use of the handle 5 for lifting the machine 1, the weight of the exercise machine 1 is shifted to the wheels, rollers, or casters 7 and the exercise machine 1 is easily transportable.

Figure 2:
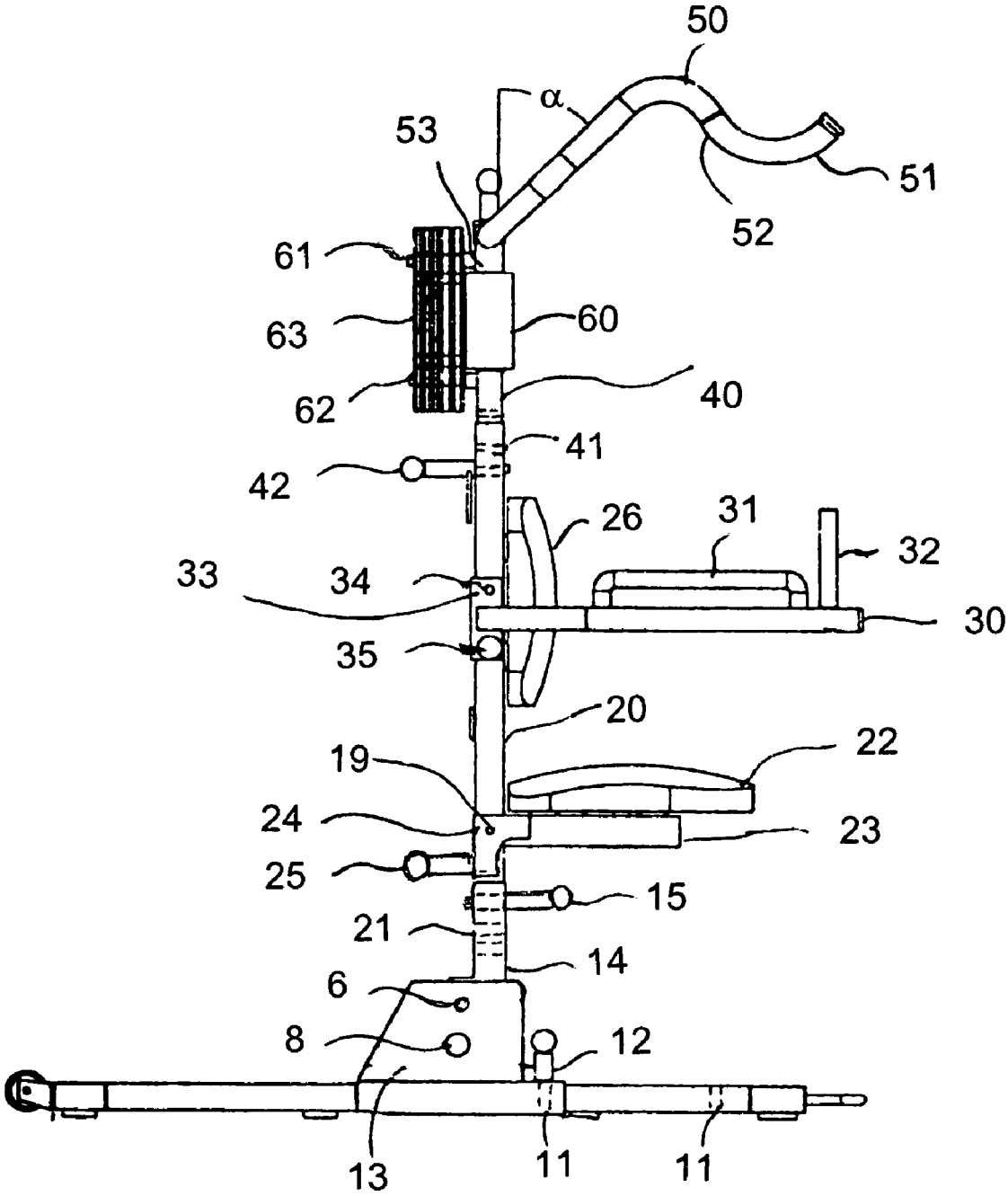
FIG. 2 is a diagrammatic, side view of the abdominal exercise machine.

FIG. 2 shows a bracket 13 supported by the base frame 2 that can be adjustably moved and positioned on the base frame 2. A top surface of the vertical member 4 has a series of holes 11 formed therein for receiving a pin 12 formed on the bracket 13. As shown between FIGS. 2 and 5, the bracket 13 can be moved and secured to the frame 2 at various positions via the pin 12 and the holes 11. It is noted that FIG. 5 differs from FIG. 2 in that two pins 12 are provided on the side of the bracket 13 and that the holes 11 are provided on the side of the vertical frame 4 instead of the top position mounting shown in FIG. 2.

Figure 6:
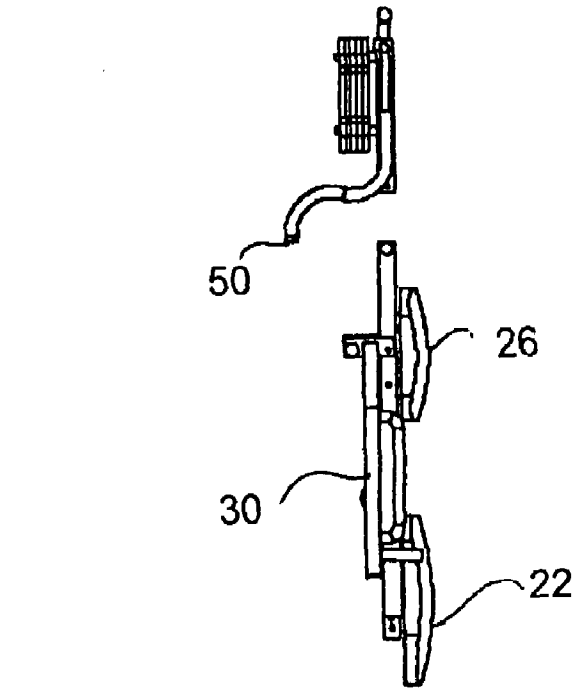
FIG. 6 is a diagrammatic exploded, side-elevational view of the second embodiment of the exercise machine with the seat and the arm rests in a vertical position.

The bracket 13 pivotally mounts a first post 14 which can be set in either a vertical position or a horizontal position as best shown in FIGS. 5 and 6. The first post 14 is mounted to the bracket 13 via a pivot pin 6 (FIG. 2) that lets the bracket 13 rotate around the pivot pin 6 between the positions shown in FIGS. 5 and 6. A locking pin 8 extends from a first side of the bracket 13, through the first post 14, and into a second side of the bracket 13. By pulling the locking pin 8 out, the first post 14 is released and can rotate. The locking pin 8 is spring biased to be normally in a locked position preventing the first post 14 from pivoting and is of the type known as a quick fit pull pin. Because the first post 14 can pivot to a generally horizontal position, the exercise machine can be collapsed to a more compact storage configuration.

The first post 14 receives a second post 20. The second post 20 has a plurality of holes 21 for being engaged by a pin 15 secured to the first post 14. By use of the pin 15 and the selection of one of the holes 21, the height of the second post 20 can be adjusted as the second post 20 moves up and down inside of the first post 14. FIG. 5 shows an alternative embodiment where the holes 21 and the pin 15 are formed on the side rather than in front. By this adjustment capability of the two posts 14, 20 the unit can be raised or lowered per the users preference. Namely, a seat height is adjusted.

The second post 20 supports a seat frame 23 carrying a padded seat 22. A first clamp 24 connects the seat frame 23 to the second post 20. The first clamp 24 has two holes. A first hole receives a pivot pin 19 and a second hole receives a locking pin 25. The pivot pin 19 extends through a first side of the clamp 24, through the second post 20 and is secured on a second side of the clamp 24 by a nut or similar type fastener. The locking pin 25 extends from a backside of the clamp 24, through the second post 20, and extends out from a front side of the second post 20. By pulling the locking pin 25 out, the first clamp 24 is unlocked or released and can rotate or pivot resulting in the seat 22 being pivoted between the two positions shown in FIGS. 5 and 6. The locking pin 25 is spring biased to be normally in a locked position preventing the first clamp 24 from rotating or pivoting.

The locking pin 25 is also of the type known as a quick fit pull pin. By placing the seat 22, 23 in the vertical position, and out of the way, a different set of abdominal exercises can be performed.

Figure 3:
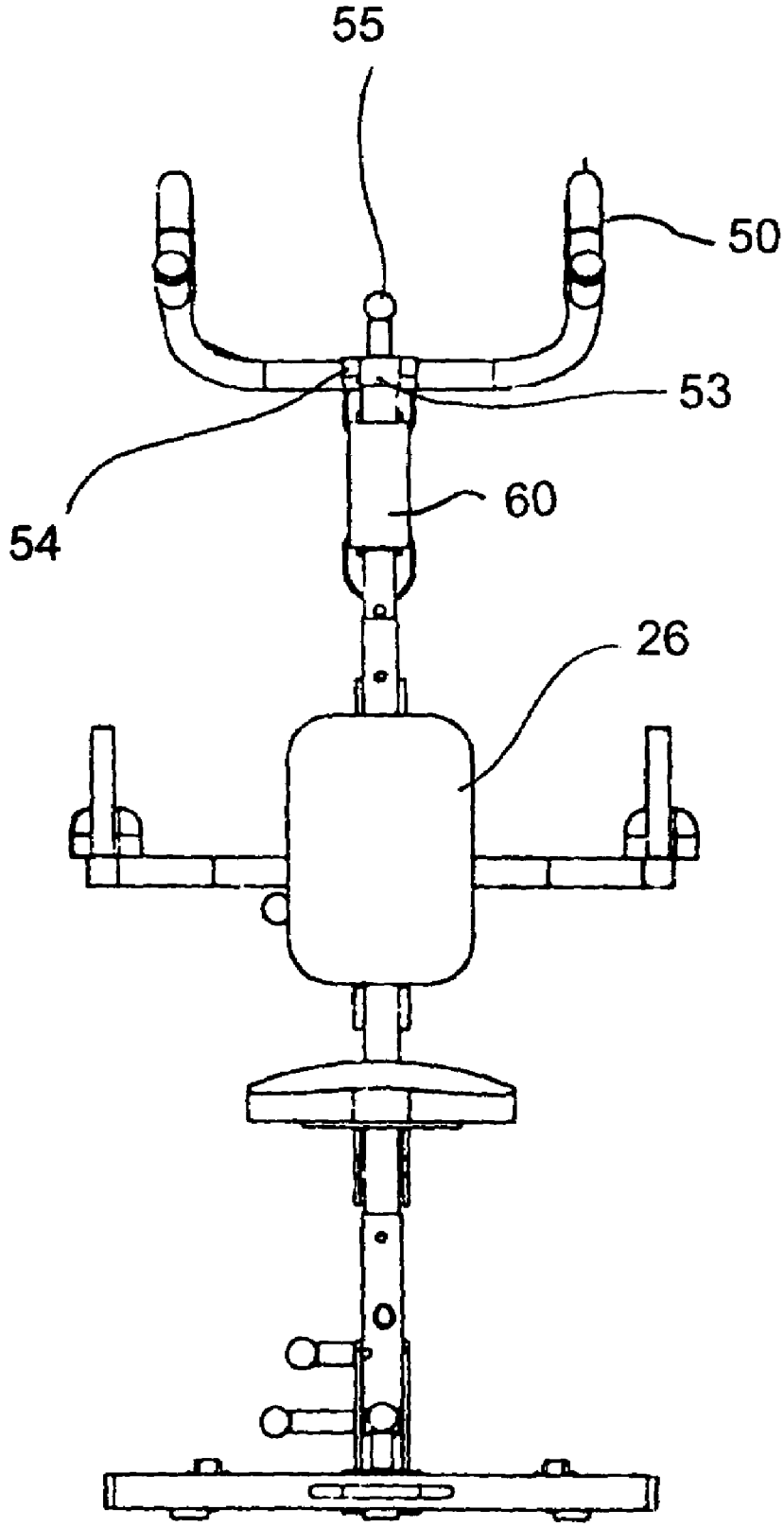
FIG. 3 is a diagrammatic front view of the abdominal exercise machine.

A padded seat back 26 is also supported on the second post 20 and is best shown in FIG. 3.

Figure 4:
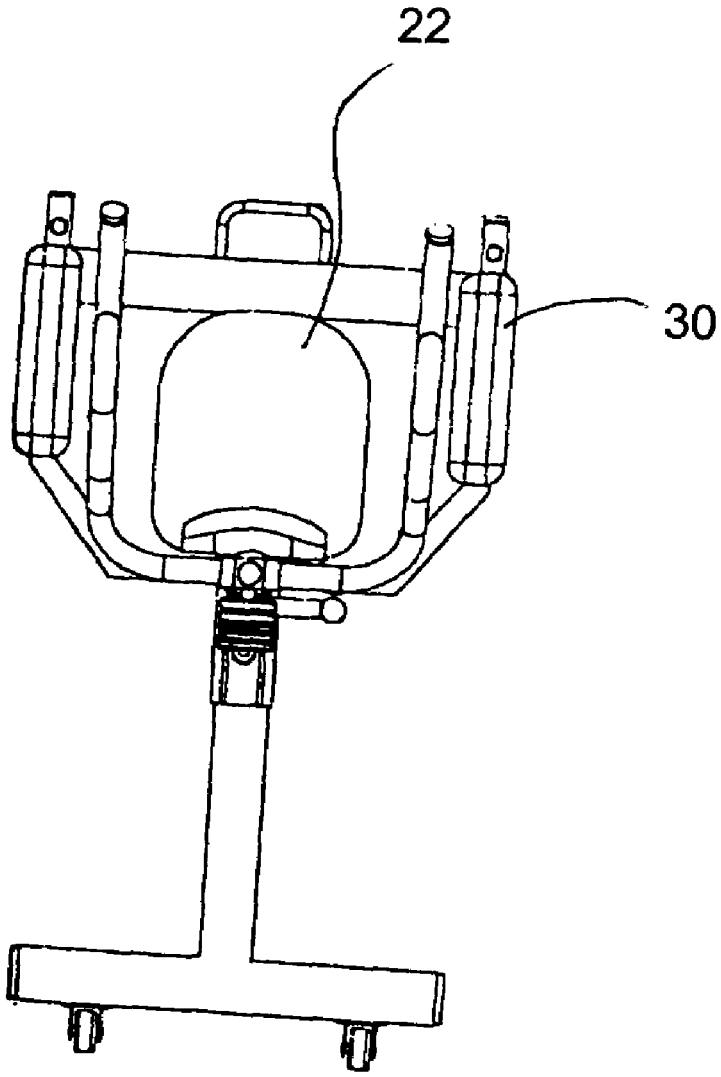
FIG. 4 is a diagrammatic top, plan view of the abdominal exercise machine.

FIGS. 2 and 4 show a pair of armrests 30 extending from the second post 20. The armrests 30 may optionally be padded with pads 31 for comfort. Each of the armrests 30 has a handle 32 that provides a griping point for assisting in exercising. A second clamp 33 interfaces the armrest 30 with the second post 20. The armrests 30 can either be locked in a horizontal position as shown in FIGS. 2 and 5 or lowered to a vertical position as shown in FIG. 6. In the vertical position, the armrests 30 are aligned with the second post 20. The second clamp 33 is secured to the second post 20 by a pivot pin 34. The pivot pin 34 extends through a first side of the second clamp 33, through the second post 20 and is secured on a second side of the second clamp 33 by a nut or similar type fastener. A locking pin 35 extends from the first side of the second clamp 34, through the second post 20, and extends out from the second side of the second clamp 34. By pulling the locking pin 35 out, the second clamp 34 is unlocked and can pivot resulting in the arm rest 30 being pivoted between the two positions shown in FIGS. 5 and 6. The locking pin 35 is of the type known as a quick fit pull pin.

A third post 40 is adjustably connected to the second post 20. The third post 40 has a plurality of holes 41 and is slid into the second post 20. A spring biased locking pin 42 is secured to the second post 40 and extends through one of the holes 41 in the third post 40 for adjustably securing the second and third posts 20, 40 to each other. By pulling the locking pin 42 out, the second and third posts 20, 40 are disengaged from each other and one can then adjust the height of the third post 40. The locking pin 42 is spring biased to a locked position.

Secured to the third post 40 is a handle bar 50 with rubberized handgrips 51. The handle bar 50 ends in a curved shaped which provides three functions. First it provides various hand positions for the different exercises to be performed. Second, it accommodates differently sized users with various hand positions. Third, the curved shape handle bar results in intensification of the exercise. The curved end 52 of the handle bar preferably has a reversed S-shape and the handle bar 50 has a generally sinuous curved shape.

The handle bar 50 protrudes forward so that it is positioned above the shoulders of a user and has its main arm members at an angle $\alpha$ between 40-70 degrees, preferably being 45 or 55 degrees in relationship to the third post (see FIG. 2). The handle bar 50 is clamped to the third post 40 such that it can be locked in a horizontal position or pivoted to the vertical position as shown in FIGS. 5 and 6. As best shown in FIG. 3, a third clamp 53 is secured to the top of the third post 40. The handle bar 50 extends through the third clamp 53. Securing rings 54 are disposed around the handle bar 50 on both sides of the third clamp 53. In this manner the handle bar 50 is kept in place in regards to the third clamp 53 by the securing rings 54. The handle bar 50 is adjustably mounted in the third clamp 53 between a storage position as shown in FIG. 6 and an exercise position as shown in FIG. 5. A spring biased locking pin 55 is secured to the third clamp 53 and extends into holes formed in the handle bar 50. By pulling the locking pin 55 out, the handle bar 50 can be rotated between the storage or exercise positions. The locking pin 55 is spring biased to a locked position and is a quick fit pull pin.

Formed integrally in the third post 40 is a resilient member 60 such as a spring that allows the third post 40 to be bent downward via force applied to the handle bar 50. The handle bar 50 can also be bent downward at an angle to exercise various muscles groups. Above and below the spring 60 are upper and lower rods 61, 62 on which can be placed tension bands 63 such as rubber bands. The tension bands 63 vary in tension increments such as 5 pounds increments with a maximum capability exceeding 125 pounds of tension. The tension bands 63 are placed between the upper and lower rods 61, 62 as desired for the specific exercise to be performed. The tension bands 63 ideally are replaced by hand without the need of any tools and simply slip onto the upper and lower rods. Of course the rods 61, 62 can be threaded at their ends for receiving a fastener such as a nut for further preventing the tension bands from slipping off.

The spring 60 is integrated into the third post 40 which is positioned above the rear seat cushion 26. The high positioning of the spring 60 results in the body of the user getting a concentrated abdominal exercise with no hip flexor interaction. In addition, the position of the spring 60 assists in allowing the user to do crossover oblique exercises in many different positions. Ideally the spring is positioned at least one foot above the seat but can be 14, 16, 18, 20, 22, 24, 26 or greater inches above the seat 22. The height adjustment of the third post 40 allows for a height adjustment of the spring 60 and the handle bar 50.

The abdominal exercise machine places the user in a sitting upright position. The user grasps the overhead handgrips 51 of the handle bar 50 at shoulder level. The user performs a crunching motion at the abdominal level bringing the overhead handles 50 down with the upper body of the user in one fluid motion. By holding the crunch and slowly raising the body back up the user maximizes the exercise and gives the muscle both positive and negative resistance training.

The spring action of the abdominal exercise machine 1 allows the user to pivot from various angles allowing the user to pinpoint all of the different abdominal muscles. By angling the crunching movement the user can specify the oblique and the upper abdominal muscles. By turning sideways on the seat one can target either the right or the left oblique at a time.

One can also target the lower abdominal muscles by doing leg raises. To perform leg raises, the user locks the sidearm rests 30 to the horizontal position, then one adjusts the height to a desired comfort level and then lower the seat 22 to the vertical position. The user then rests his/her body weight on the armrests, while raising his/her feet up off the floor by bringing his/her knees up to the chest level, and thereby crunching the lower abdominal muscles. In essence the abdominal exercise machine allows for a full range of abdominal and lower back movements and exercises.

In addition the abdominal exercise machine is extremely user friendly in that the seat, the armrests, and the positioning of the handlebars and the spring are all adjustable in the vertical position resulting for adaptation to various body heights and torso lengths.

I claim:

1. An exercise machine, comprising:

a main frame for placement on a support surface;

a seat supported on said main frame and movable between a horizontal position and a vertical position;

a post formed with an integrated resilient member supported by said main frame, said integrated resilient member disposed at least one foot above said seat;

at least one tension band supported by said post for increasing a resistance of said integrated resilient member; and a handle bar attached to and extending from said post, a downward movement of said handle bar being resisted by said integrated resilient member.

2. The exercise machine according to claim 1, wherein:

said handle bar has a sinuous shape; and said handle bar has main arm members extending from said post at an angle between 40-70 degrees.

3. The exercise machine according to claim 1, further comprising:

a further post adjustably and releasably receiving and supporting said post, said further post supported by said main frame; and a seat back connected to said further post, said integrated resilient member disposed above said seat back.

4. The exercise machine according to claim 3, further comprising an armrest having a clamp pivotably connected to said further post for moving said armrest between a vertical and horizontal position.

5. The exercise machine according to claim 4, wherein said armrest has a pair of padded arms and two hand grips.

6. The exercise machine according to claim 3, wherein:

said post has a plurality of holes formed therein; and said further post has an opening formed therein for receiving said post and a pin for engaging said holes in said post for releasably and adjustable holding said post.

7. The exercise machine according to claim 1, wherein said post has two rods extending from a rear of said post for engaging said at least one tension band.

8. The exercise machine according to claim 3, further comprising:

a bracket adjustably connected to said main frame; and a base post pivotably mounted to said bracket and receiving said further post in an adjustable and releasable manner.

9. The exercise machine according to claim 8, wherein:

said further post having a plurality of further holes formed therein; and said base post has a locking pin for engaging one of said further holes for holding said further post in the releasable and adjustable manner.

10. The exercise machine according to claim 9, wherein:

said main frame has a plurality of frame holes formed therein; and said bracket has a frame locking pin for engaging in said frame holes for adjustably and releasably fixing said bracket to said main frame.

11. The exercise machine according to claim 1, wherein said integrated resilient member is a spring allowing a user to bend forward and side to side while gripping said handle bar.

12. The exercise machine according to claim 2, wherein said handle bar is rotatably mounted to said post and rotates between a horizontal and vertical position.

13. An exercise machine, comprising:

a main frame for placement on a support surface;

a seat supported on said main frame and movable between a horizontal position and a vertical position;

a post formed with an integrated resilient member supported by said main frame, said integrated resilient member disposed at least one foot above said seat;

a handle bar attached to and extending from said post, a downward movement of said handle bar being resisted by said integrated resilient member;

a set of rollers attached on a first end of said main frame; and a handle attached to a second end of said main frame, said second end being opposite to said first end.

14. The exercise machine according to claim 1, wherein said main frame is and an I-shaped main frame.

15. The exercise machine according to claim 9, wherein said base post has an opening formed therein receiving said further post.

16. An exercise machine, comprising:

in frame for placement on a support surface;

a seat supported on said main frame and movable between a horizontal position and a vertical position;

a post formed with an integrated resilient member supported by said main frame, said integrated resilient member disposed at least one foot above said seat;

a handle bar attached to and extending from said post, a downward movement of said handle bar being resisted by said integrated resilient member, said handle bar having an end with a reverse S shape.

17. The exercise machine according to claim 14, wherein said I-shaped main frame has a vertical member with one horizontal member disposed at each end of said vertical member, said vertical member formed with two releasably interconnecting components.

18. The exercise machine according to claim 1, wherein said integrated resilient member is disposed at least 18 inches above said seat for eliminating hip flexor interaction.

19. The exercise machine according to claim 9, wherein said locking pin is a quick fit pull pin.

* * * * *